US009803425B2

(12) United States Patent
Savage et al.

(10) Patent No.: US 9,803,425 B2
(45) Date of Patent: Oct. 31, 2017

(54) ROTARY STEERABLE DRILLING SYSTEM

(75) Inventors: John Keith Savage, Edmonton (CA); Daniel Martin Winslow, Spring, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 856 days.

(21) Appl. No.: 14/355,154

(22) PCT Filed: Sep. 14, 2012

(86) PCT No.: PCT/US2012/055327
§ 371 (c)(1),
(2), (4) Date: Apr. 29, 2014

(87) PCT Pub. No.: WO2014/042644
PCT Pub. Date: Mar. 20, 2014

(65) Prior Publication Data
US 2014/0284110 A1 Sep. 25, 2014

(51) Int. Cl.
*E21B 7/06* (2006.01)

(52) U.S. Cl.
CPC ..... *E21B 7/06* (2013.01); *E21B 7/062* (2013.01)

(58) Field of Classification Search
CPC . E21B 7/06; E21B 7/062; E21B 7/067; E21B 7/04
USPC ..... 175/61, 73
See application file for complete search history.

(56) References Cited

U.S. PATENT DOCUMENTS

| | | | | |
|---|---|---|---|---|
| 5,186,264 | A | 2/1993 | Du Chaffaut | |
| 5,427,329 | A | 6/1995 | Renzelmann et al. | |
| 5,669,457 | A * | 9/1997 | Sebastian | E21B 7/067 166/117.7 |
| 5,971,085 | A | 10/1999 | Colebrook | |
| 6,550,548 | B2 | 4/2003 | Taylor | |

(Continued)

FOREIGN PATENT DOCUMENTS

| | | | |
|---|---|---|---|
| CN | 101454532 | A | 6/2009 |
| WO | WO-03002841 | A1 | 1/2003 |

OTHER PUBLICATIONS

Written Opinion of the International Searching Authority; dated Nov. 19, 2012; 7 pages; International Searching Authority, U.S.

(Continued)

*Primary Examiner* — Michael Wills, III

(57) ABSTRACT

A rotary steerable drilling system includes a housing, a drive shaft passing through the housing, a shaft/housing locking mechanism disposed to selectively engage the drive shaft and the housing, and an anti-rotation mechanism disposed to engage a wellbore wall. Shaft/housing locking mechanism includes a first configuration in which rotation of the drive shaft is independent of the housing, and a second configuration in which rotation of the drive shaft causes rotation of the housing. Anti-rotation mechanism includes a first configuration in which the anti-rotation mechanism extends radially relative to the drive shaft, and a second configuration in which the anti-rotation mechanism retracts from engagement with the wellbore wall. A timing mechanism may be employed to transition the anti-rotation mechanism from the first configuration to the second configuration before the shaft/housing locking mechanism transitions from the first configuration to the second configuration.

12 Claims, 9 Drawing Sheets

(56) References Cited

U.S. PATENT DOCUMENTS

| | | | | |
|---|---|---|---|---|
| 7,467,672 | B2 * | 12/2008 | Cruickshank | E21B 7/067 175/106 |
| 7,730,972 | B2 | 6/2010 | Hall et al. | |
| 8,286,733 | B2 * | 10/2012 | Tulloch | E21B 7/067 175/320 |
| 2011/0284292 | A1 * | 11/2011 | Gibb | E21B 7/06 175/61 |

OTHER PUBLICATIONS

1st Office Action dated Dec. 7, 2015 for Chinese Patent Application No. 201280075799X, 19 pages.

International Search Report and The Written Opinion of the International Searching Authority, or the Declaration, dated Dec. 13, 2012, PCT/US12/55327, 10 pages, International Searching Authority, U.S.

European Patent Office, Supplementary European Search Report, dated May 17, 2016, 6 pages, Europe.

* cited by examiner

ROTARY STEERABLE DRILLING SYSTEM

The present application is a U.S. National Stage patent application of International Patent Application No. PCT/US2012/055327, filed on Sep. 14, 2012, the benefit of which is claimed and the disclosure of which is incorporated herein by reference in its entirety.

BACKGROUND

This disclosure generally relates to drilling systems and more particularly, to rotary steerable drilling systems for oil and gas exploration and production operations.

Rotary steerable drilling systems allow a drill string to rotate continuously while steering the drill string to a desired target location in a subterranean formation. Rotary steerable drilling systems typically include stationary housings that engage a wellbore wall to inhibit relative rotation therebetween permitting the stationary housing to be used as a reference to steer the drilling tool in a desired direction. However, issues arise with such drilling system configurations when the drilling tool becomes stuck since the stationary housing may impede the ability to dislodge the stuck drilling tool.

BRIEF DESCRIPTION OF THE DRAWINGS

A more complete understanding of this disclosure and advantages thereof may be acquired by referring to the following description taken in conjunction with the accompanying figures, wherein.

Figure 1:
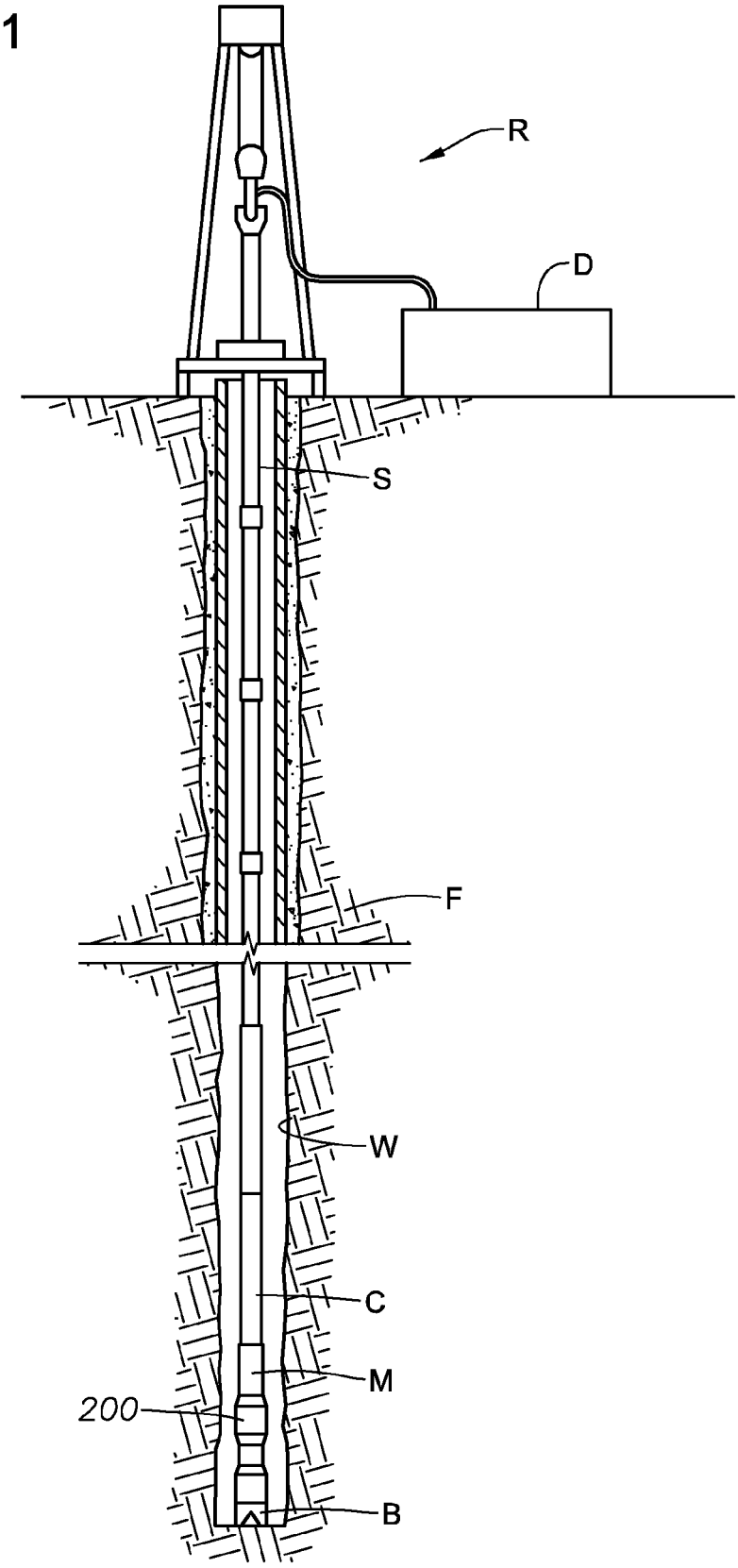
FIG. 1 is a partial cross-section view illustrating an embodiment of a drilling rig for drilling a wellbore with the drilling system in accordance with the principles of the present disclosure.

While this disclosure is susceptible to various modifications and alternative forms, specific exemplary embodiments thereof have been shown by way of example in the drawings and are herein described in detail. It should be understood, however, that the description herein of specific embodiments is not intended to limit the disclosure to the particular forms disclosed, but on the contrary, the intention is to cover all modifications, equivalents, and alternatives falling within the spirit and scope of the disclosure as defined by the appended claims.

DETAILED DESCRIPTION

This disclosure generally relates to drilling systems and more particularly to rotary steerable drilling systems for oil and gas exploration and production operations.

Rotary steerable drilling systems of the invention are provided herein that, among other functions, may be used to provide rotary steerable drilling operations in which a housing engages the wall of a wellbore and a drive shaft is rotated relative to the housing during rotary steerable drilling operations. When the rotary steerable drilling systems of the invention is to be moved, the housing disengages the wellbore wall and is locked to the drive shaft, thereby permitting the housing to be rotated with the drive shaft. In some embodiments, if a drilling tool that is coupled to the rotary steerable drilling system of the present disclosure becomes stuck in the formation during rotary steerable drilling operations, the housing may be rotated relative to the formation in order to help dislodge the drilling tool from the formation.

To facilitate a better understanding of this disclosure, the following examples of certain embodiments are given. In no way should the following examples be read to limit, or define, the scope of the disclosure.

For ease of reference, the terms "upper," "lower," "upward," and "downward" are used herein to refer to the spatial relationship of certain components. The terms "upper" and "upward" refer to components towards the surface (distal to the drill bit or proximal to the surface), whereas the terms "lower" and "downward" refer to components towards the drill bit (proximal to the drill bit or distal to the surface), regardless of the actual orientation or deviation of the wellbore or wellbores being drilled.

FIG. 1 of the drawings illustrates a drill string, indicated generally by the reference letter S, extending from a conventional rotary drilling rig R and in the process of drilling a well bore W into an earth formation F. The lower end portion of the drill sting S includes a drill collar C, a subsurface drilling fluid-powered motor M, and a drill tool or bit B at the end of the string S. The drill bit B may be in the form of a roller cone bit or fixed cutter bit or any other type of bit known in the art. A drilling fluid supply system D circulates a drilling fluid, such as drilling mud, down through the drill string S to assist in the drilling operation. The fluid then flows back to the rig R, such as by way, for example, of the annulus formed between the well bore W and the drill string S. In certain configurations, the well bore W is drilled by rotating the drill string S, and therefore the drill bit B, from the rig R in a conventional manner. In other configurations, the drill bit B may be rotated with rotary power supplied by the subsurface motor M by virtue of the circulating fluid. Since all of the above components are conventional, they will not be described in detail. Those skilled in the art will appreciate that these components are recited as illustrative for contextual purposes and not intended to limit the invention described below.

Figure 2A:
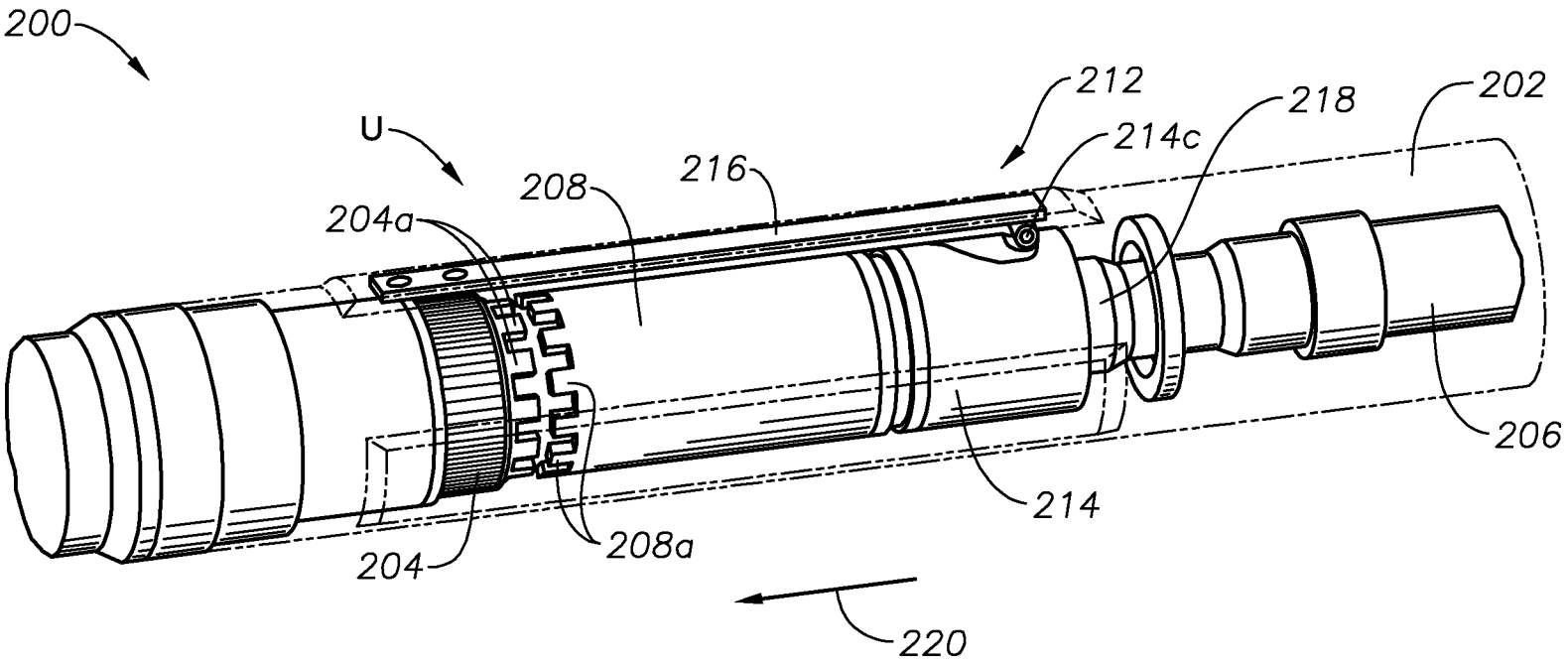
FIG. 2*a* is a transparent perspective view illustrating an embodiment of rotary steerable drilling system.
Figure 2B:
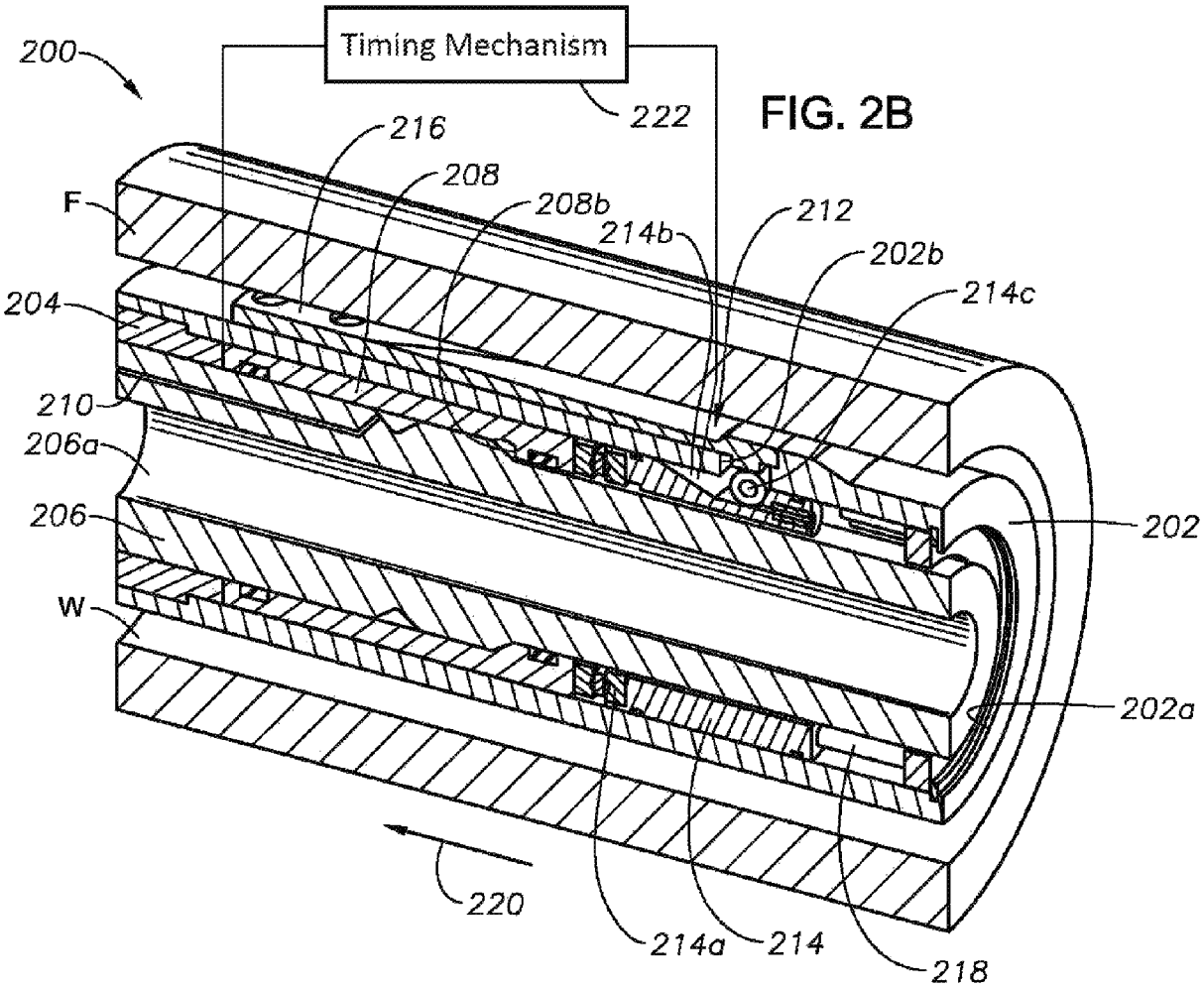
FIG. 2*b* is a cross-sectional perspective view illustrating an embodiment of the rotary steerable drilling system of FIG. 2*a*.

Referring now to FIGS. 1, 2*a*, and 2*b*, an embodiment of a rotary steerable drilling system 200 is illustrated. In the embodiment illustrated in FIG. 1, the rotary steerable drilling system 200 is positioned on the drill string S between the subsurface motor M and the drill bit B. However, one of skill in the art will recognize that the positioning of the rotary steerable drilling system 200 on the drill string S and relative to other components on the drill string S may be modified while remaining within in the scope of the present disclosure.

The rotary steerable drilling system 200 includes a housing 202 that, during operation of the rotary steerable drilling system 200, is positioned in the wellbore W. The housing 202 defines a housing bore 202*a* that extends through the housing 202 along its longitudinal axis. A housing locking member 204 extends from the housing 202 into the housing bore 202*a*. In an embodiment, the housing locking member 204 may be integral to the housing 202. In another embodiment, the housing locking member 204 may be secured to the housing 202 using methods known in the art. For example, as illustrated in FIG. 2a, the housing locking member 204 may include a plurality of circumferentially spaced splines that engage the housing 202 to resist relative movement between the housing locking member 204 and the housing 202. The housing locking member 204 also includes an engagement structure 204a. In certain preferred embodiments, the engagement structure 204a is a plurality of teeth that are formed at an end of the housing locking member 204. Teeth 204a are preferably arranged in a circumferentially spaced apart orientation from each other such that a plurality of channels are defined between the respective pairs of teeth 204a.

A drive shaft 206 extends axially through housing bore 202a. The drive shaft 206 is characterized by a drive shaft bore 206a that extends axially through the drive shaft 206. An axially movable shaft locking member 208 is mounted on the drive shaft 206 adjacent the housing locking member 204. In certain preferred embodiments, shaft locking member 208 is a sleeve disposed around drive shaft 206. In certain embodiments, the shaft locking member 208 is mounted on drive shaft 206 and disposed to move axially relative to the drive shaft 206 along the longitudinal axis of the drive shaft 206, but constrained from rotational movement relative to the drive shaft 206 (e.g., the shaft locking member 208 may be splined to the drive shaft 206.) In any event, the shaft locking member 208 includes an engagement structure 208a configured to releaseably engage the engagement structure 204a of the housing locking member 204. In certain preferred embodiments, the engagement structure 208a is a plurality of teeth that are formed at an end of the shaft locking member 208. Teeth 208a are preferably arranged in a circumferentially spaced apart orientation from each other such that a plurality of channels are defined between respective pairs of teeth 208a. Shaft locking member 208 is also characterized by a pressure surface 208b defined thereon. A shaft locking member actuation channel 210 is provided to interface with the shaft locking member 208, and in particular, to provide fluid communication to the pressure surface 208b of shaft locking member 208. In one preferred embodiment, the actuation channel 210 is formed in drive shaft 206.

As described in further detail below, the housing locking member 204 on the housing 202 and the shaft locking member 208 on the drive shaft 206 are disposed to engage one another thereby providing a mechanism to lock the shaft and the housing together. While each of the housing locking member 204 and the shaft locking member 208 are illustrated and described as substantially cylindrical members that are positioned adjacent each other around the circumference of the drive shaft 206 with circumferentially spaced teeth that engage to provide the shaft/housing locking mechanism, one of skill in the art will recognize that the function of the shaft/housing locking mechanism may be provided by a variety of housing locking members, shaft locking members, and/or other components that include structures and features that different from those illustrated but that would fall within the scope of the present disclosure.

An anti-rotation mechanism 212 is included in the rotary steerable drilling system 200 and includes an anti-rotation actuator 214 and a formation engagement device 216 that are moveably coupled to the housing 202. The anti-rotation actuator 214 includes a ramp member 214b, and a formation engagement device actuator 214c that is moveably coupled to the ramp member 214b and located in a opening or channel 202b defined in the housing 202 and that allows the formation engagement device actuator 214c to extend through the housing 202 to engage the formation engagement device 216. A coupling 214a, preferably in the form of a bearing, is disposed between the anti-rotation actuator 214 and the shaft locking member 208 to permit relative rotation therebetween. A biasing member 218 is located adjacent the anti-rotation mechanism 212 and the drive shaft 206 and provides a biasing force that biases the anti-rotation device 212 and the shaft locking member 208 in a direction 220.

Figure 3A:
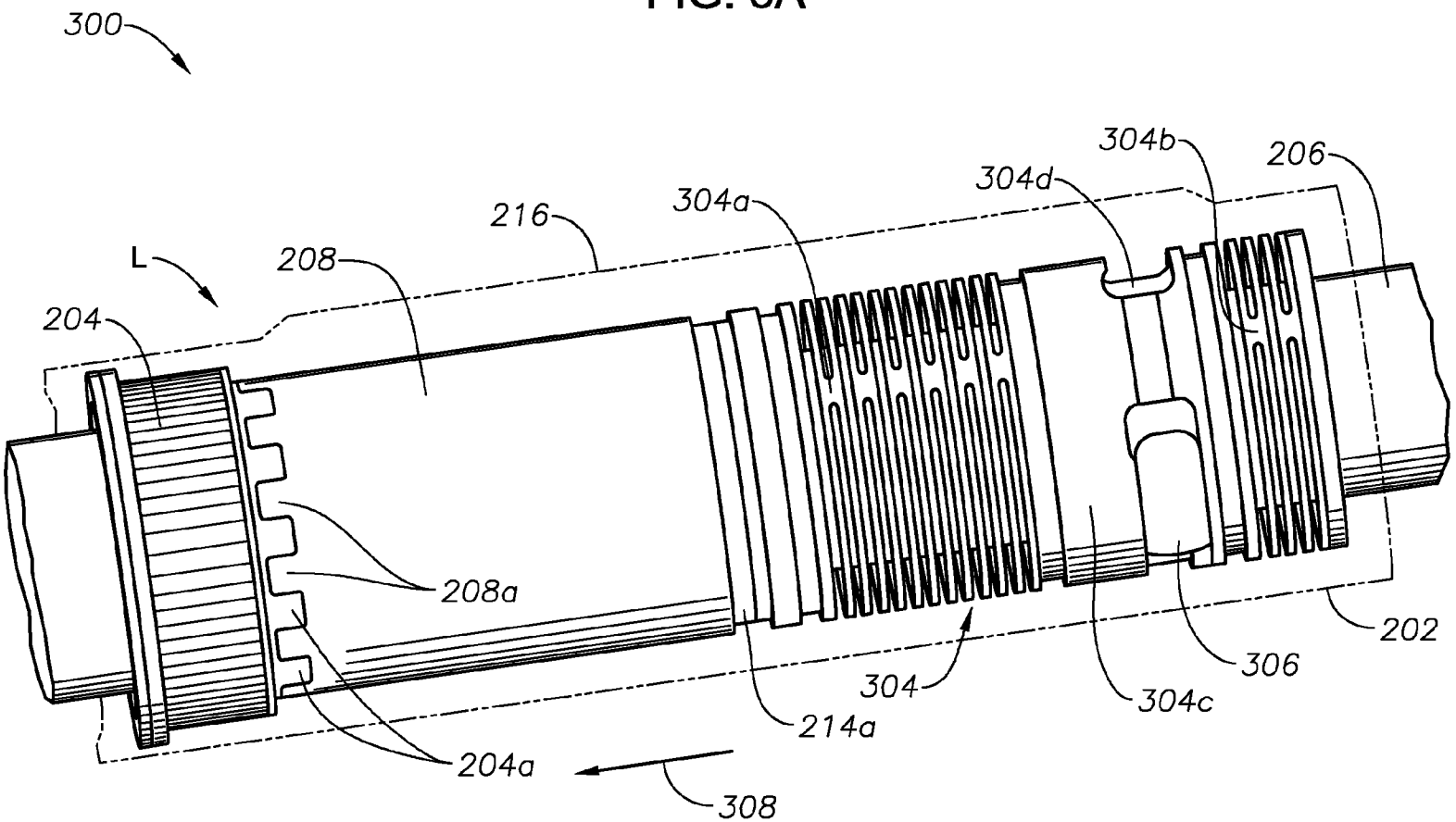
FIG. 3*a* is a transparent perspective view illustrating an embodiment of rotary steerable drilling system.
Figure 3B:
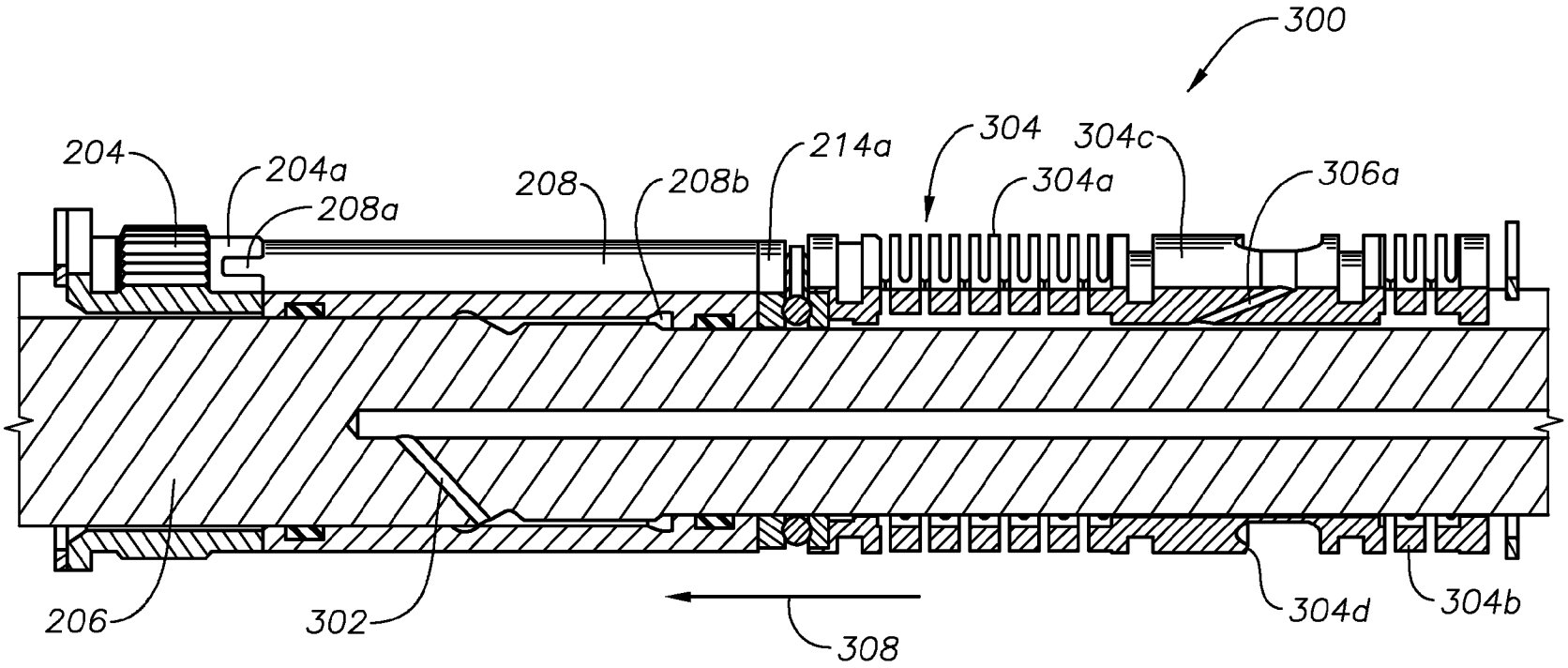
FIG. 3*b* is a cross-sectional view illustrating an embodiment of the rotary steerable drilling system of FIG. 3*a*.

Referring now to FIGS. 1, 3a, and 3b, an embodiment of a rotary steerable drilling system 300 is illustrated that includes some features similar to the rotary steerable drilling system 200 discussed above with reference to FIGS. 2a and 2b. Thus, since some of the features of the rotary steerable drilling system 300 already have been described above with reference to FIGS. 2a and 2b, they may not be illustrated or described with respect to the rotary steerable drilling system 300 for clarity of discussion.

The rotary steerable drilling system 300 includes the housing 202 that, during operation of the rotary steerable drilling system 300, is positioned in the wellbore W. The housing 202 may also define the housing bore 202a that extends through the housing 202 along its longitudinal axis. The housing locking member 204 extends from the housing 202 into the housing bore 202a, and includes a housing locking member 204a in the form of a plurality of teeth that are located on a end of the housing locking member 204 in a circumferentially spaced apart orientation from each other, thereby forming a plurality of teeth channels defined between respective pairs of teeth 204a. The drive shaft 206 extends axially through the housing bore 202a of housing 202. The drive shaft 206 may include a drive shaft bore 206a defined therein (not illustrated in FIGS. 3a and 3b) that extends through the drive shaft 206 along its longitudinal axis. The shaft locking member 208 is mounted on the drive shaft 206 adjacent the housing locking member 204 and is disposed to move axially along the driveshaft 206 while constrained from rotational movement. The shaft locking member 208 includes an engagement structure 208a disposed to releasably engage the engagement structure 204a of the housing locking member 204. In the illustrated embodiment, engagement structure 208a is a plurality of teeth 208a that are located on a end of the shaft locking member 208 in a circumferentially spaced apart orientation from each other, thereby forming a plurality of teeth channels defined between respective pairs of teeth 208a.

The drive shaft 206 defines a shaft locking member actuation channel 302 that interfaces with the shaft locking member 208, as illustrated in FIG. 3b, and in particular, provides fluid communication to the pressure surface 208b of shaft locking member 208. An integrated anti-rotation/biasing member 304 is coupled to the shaft locking member 208 through the coupling 214a, which may be, for example a bearing that allows rotation of anti-rotation/biasing member 304 relative to shaft locking member 208 as described below. While the integrated anti-rotation/biasing member 304 is illustrated and described as a substantially cylindrical member that is positioned around the circumference of the drive shaft 206, one of skill in the art will recognize that the function of the integrated anti-rotation/biasing member may be provided by a variety of integrated anti-rotation/biasing member that include structures and features that different from those illustrated but that would fall within the scope of the present disclosure.

In the illustrated embodiment, the integrated anti-rotation/biasing member 304 includes one or more unique spring members 304*a*, 304*b* characterized by a plurality of circumferential spring ribs integrally formed as part of anti-rotation/biasing member 304. Anti-rotation/biasing member 304 also includes a base 304*c* having an opening or seat 304*d* formed therein for receipt a formation engagement device actuator 306 similar to the formation engagement device actuator 214*c* described above. In certain embodiments, formation engagement device actuator 306 may be a cam. In an embodiment, the circumferential spring ribs may be machined into the integrated anti-rotation/biasing member 304, using methods known in the art, including a number and spacing that will provide a predetermined biasing force that biases the shaft locking member 208 in a direction 308. The anti-rotation mechanism base 304*c* is integrated with the spring members 304*a*, 304*b*. A clean-out channel 306*a* may be provided to flush out the area around base 304*c*. Upon introduction of a pressurized fluid into channel 302, pressure is applied to pressure surface 208*b*, thereby urging shaft locking member 208 in a direction opposite of 308. In so doing, shaft locking member 208 urges anti-rotation/biasing member 304 axially in a direction opposite of 308. In turn, such axial movement actuates formation engagement device actuator 306, which causes one or more anti-rotation members 216 to move radially outward toward engagement with the wellbore wall. Springs 304*a*, 304*b* may be used to control extension of anti-rotation members 216. base 304*c* base 304*c*

Figure 4:
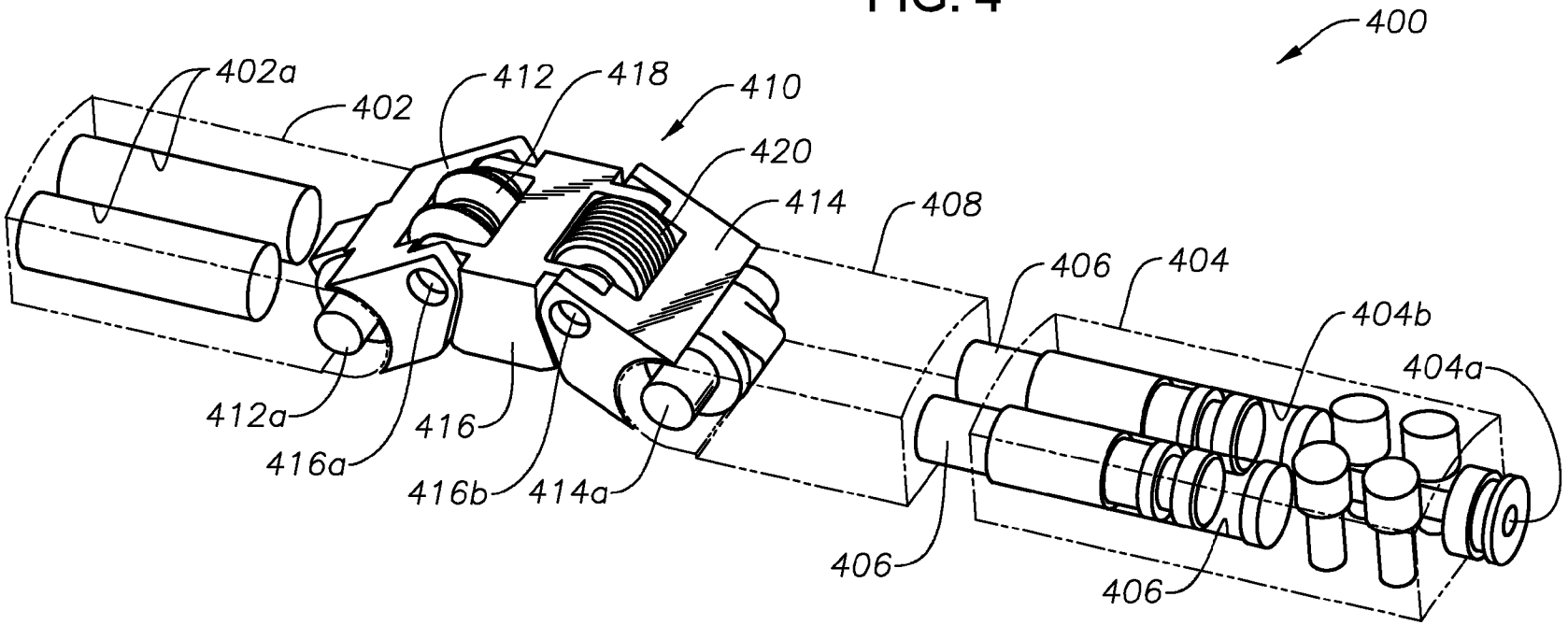
FIG. 4 is a transparent perspective view illustrating an embodiment of anti-rotation mechanism.

Referring now to FIG. 4, an embodiment of an anti-rotation mechanism 400 is illustrated. Anti-rotation mechanism 400 may be provided, for example, on the rotary steerable drilling system 200 in place of the anti-rotation mechanism 212, discussed above with reference to FIGS. 2*a* and 2*b*, or on the rotary steerable drilling system 300 in place of the anti-rotation mechanism base 304*c* and anti-rotation members 216, discussed above with reference to FIGS. 3*a* and 3*b*. The anti-rotation mechanism 400 includes a biasing member mechanism 402 that defines one or more biasing member seats 402*a* disposed to accept biasing member, such as, for example, a spring or movable piston. The anti-rotation mechanism 400 also includes an actuation member base 404 having an actuation channel 404*a* that may be in fluid communication with the shaft locking member actuation channel 210 on the rotary steerable drilling system 200 or the shaft locking member actuation channel 302 on the rotary steerable drilling system 300. In any event, the actuation member base 404 also includes one or more actuation member bores 404*b* in fluid communication with the actuation channel 404*a*. Each bore 404*b* includes an actuation piston 406 slidingly disposed therein. Actuation piston 406 engages a coupling 408 at the distal end of the actuation piston 406.

Figure 5:
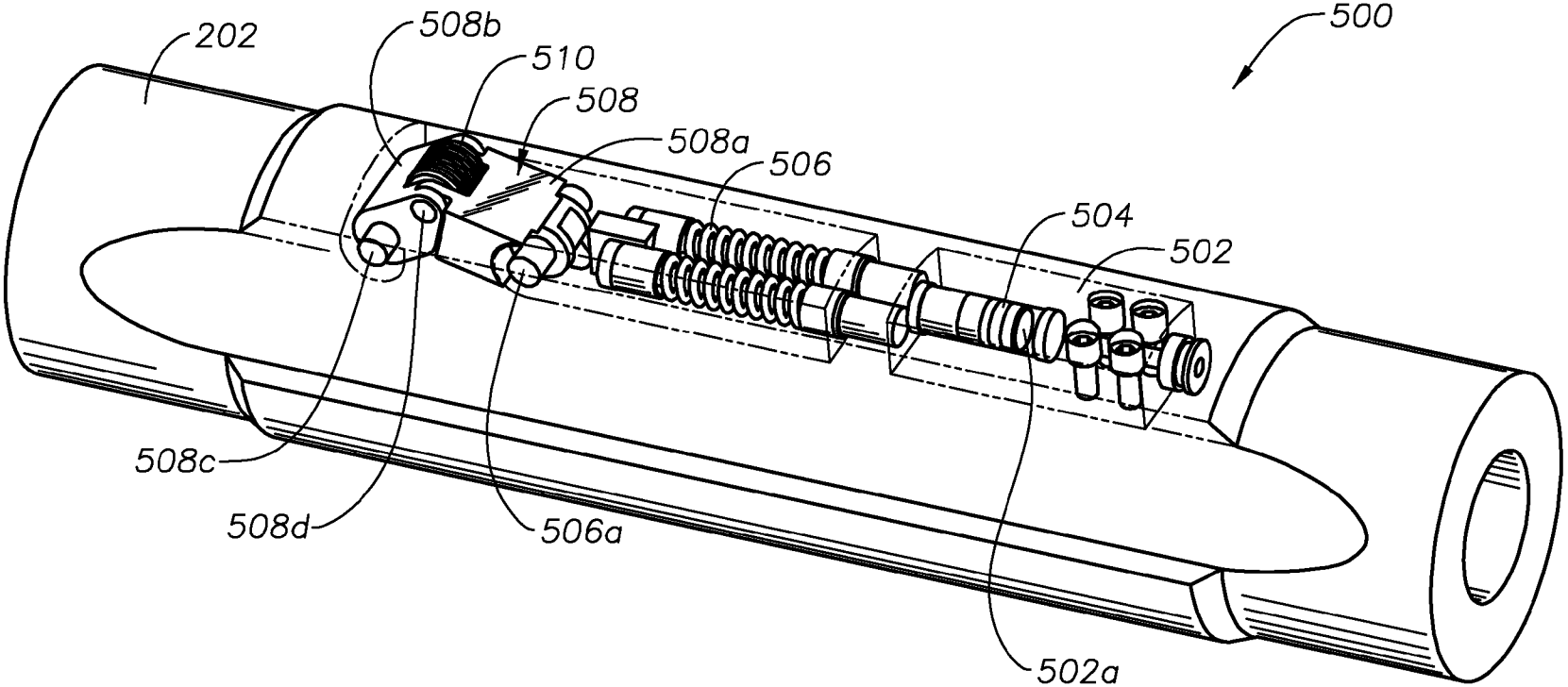
FIG. 5 is a transparent perspective view illustrating an embodiment of anti-rotation mechanism on a rotary steerable drilling system.

The anti-rotation mechanism 400 also includes a formation engagement member 410 having a first section 412 that is moveably linked to the biasing member mechanism 402 through a pivotal coupling 412*a*, and a second section 414 that is moveably linked to coupling 408 through a pivotal coupling 414*a*. A third section 416 of the formation engagement member 410 is moveably coupled to each of the first section 412 and the second section 414 through pivotal couplings 416*a* and 416*b*, respectively. A plurality of engagement wheels 418 and 420 are moveably coupled to the formation engagement member 410 through, for example, the pivotal couplings 416*a* and 416*b*. Wheels 418 and 420 are preferably of a size and shape, and, otherwise disposed on an axis perpendicular to the axis of the wellbore, so as to inhibit rotational movement of housing 202 when wheels 418, 420 engage the wall of wellbore W. Referring now to FIG. 5, an embodiment of an anti-rotation mechanism 500 is illustrated that may be provided, for example, on the rotary steerable drilling system 200 in place of the anti-rotation mechanism 212, discussed above with reference to FIGS. 2*a* and 2*b*, or on the rotary steerable drilling system 300 in place of the anti-rotation mechanism base 304*c* and anti-rotation members 216, discussed above with reference to FIGS. 3*a* and 3*b*. The anti-rotation mechanism 500 may be coupled to the housing 202 on either of the rotary steerable drilling systems 200 or 300. The anti-rotation mechanism 500 includes a housing mount 502 that is secured to the housing 202 and defines a piston bore 502*a* within housing mount 502. Piston bore 502*a* may be in fluid communication with the shaft locking member actuation channel 210 on the rotary steerable drilling system 200 or the shaft locking member actuation channel 302 on the rotary steerable drilling system 300. A piston 504 is slidingly disposed within piston bore 502*a*. Piston 504 is disposed to urge against a biasing member 506. Biasing member 506 is disposed to engage a pivotal coupling 506*a*. A formation engagement member 508 includes a first section 508*a* that is moveably coupled to the pivotal coupling 506*a*, and a second section 508*b* that is moveably coupled to the housing 202 by a pivotal coupling 508*c*. The first and second sections 508*a* and 508*b* of the formation engagement member 508 are moveably coupled to each other by a pivotal coupling 508*d*. The formation engagement member 508 also includes one ore more engagement wheels 510 that are moveably coupled to the formation engagement member 508 preferably through pivotal coupling 508*d*.

Figure 6:
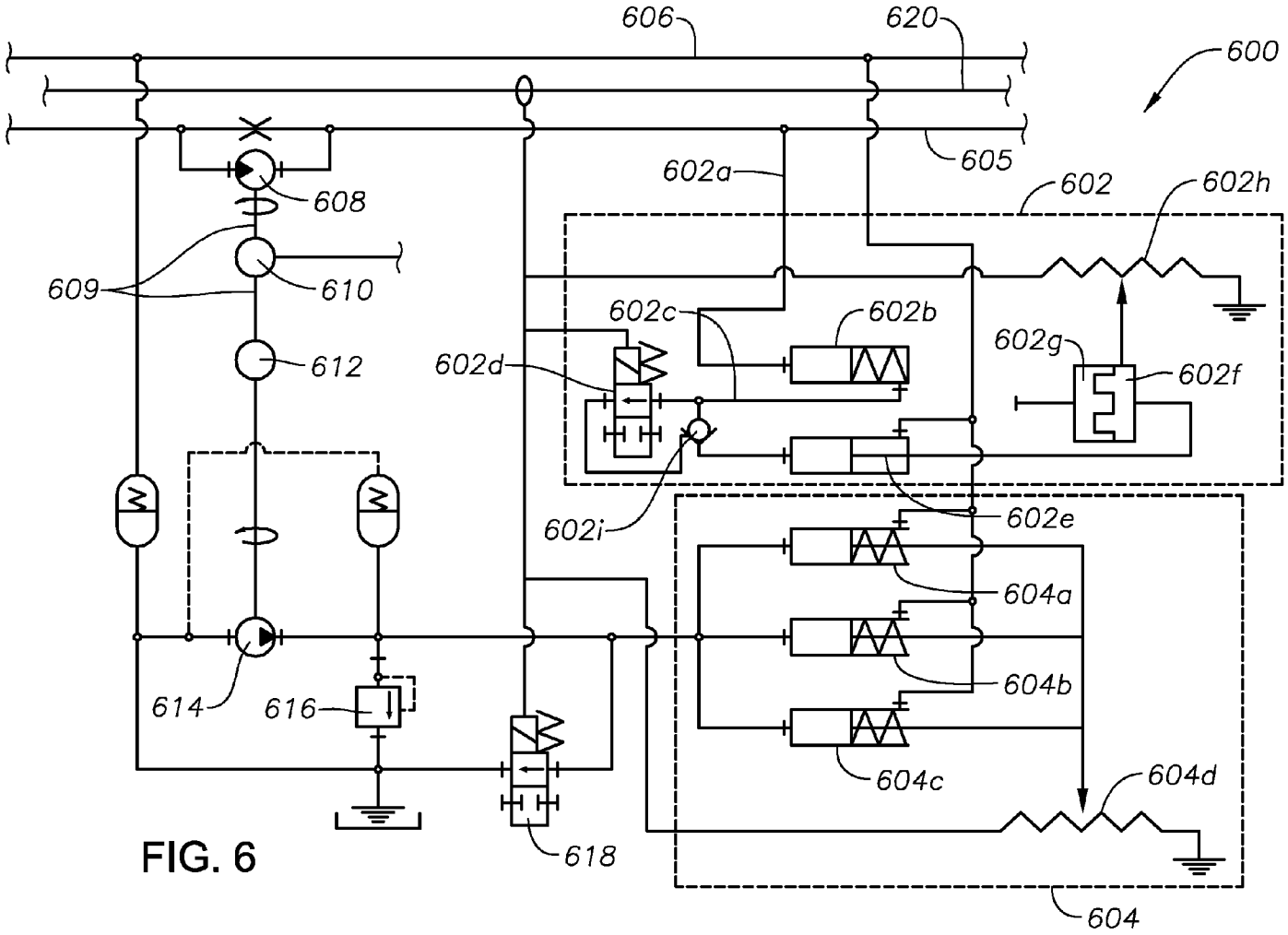
FIG. 6 is a schematic view illustrating an embodiment of a rotary steerable drilling system.

Referring now to FIG. 6, a rotary steerable drilling system 600 is illustrated that may be, for example, the rotary steerable drilling systems 200 and/or 300 and/or may include the anti-rotation mechanisms 212, 304, 400 or 500, discussed above. The rotary steerable drilling system 600 generally includes a shaft/housing locking mechanism 602 and an anti-rotation mechanism 604. Drilling mud (not shown) enters the rotary steerable drilling system 600 through a standpipe or tubular 605, such as a drill string, disposed in the wellbore W. An annulus 606 is formed between standpipe 605 and wellbore W. As a non-limiting example, in certain embodiments, the drilling mud may characterized by a flow rate of approximately 350 gallons per minute (GPM), a pressure between approximately 400 and 1200 pounds per square inch (PSI), a drilling fluid density of approximately 7.5 to 20 PPG, and a temperature of approximately 200 degrees Centigrade. The drilling mud drives an axial turbine 608 which in turn drives a rotating shaft 609. Shaft 609 may be coupled to an electric generator 610 to generate electricity for drill string components. Shaft 609 may also be used to drive pump 614. Gear reduction may be provided by gear reducer 612. Pump 614 is connected to a hydraulic system and may be used to pressurize the hydraulic fluid utilized to activate anti-rotation mechanism 604. An electric solenoid valve 618 may also be provided to permit surface control of the anti-rotation mechanism 604, as well as to provide additional fail-safe functionality. A max pressure limiter 616 may likewise be provided.

The shaft/housing locking mechanism 602 receives the drilling mud through a line 602*a* that is coupled to a mud over hydraulic fluid piston 602*b*. The piston 602*b* uses the drilling mud to pressurize hydraulic fluid in the shaft/housing locking mechanism 602, which hydraulic fluid is utilized in a hydraulic piston 602*e* to control the actuation of teeth on a shaft locking member 602*f* (which may be the shaft locking member 208) into engagement with teeth on a housing locking member 602*g* (which may be the housing locking member 204.) Line 602*c* fluidly connects piston 602*b* to piston 602*e* for delivery of the pressurized hydraulic fluid. An electric solenoid valve 602*d* may be disposed along line 602*c* to provide surface control of shaft/housing locking mechanism 602, as well as to function as a fail safe mechanism in the even of loss of surface control. Likewise, a check valve 602*i* may be disposed along line 602*c*. In certain preferred embodiments, check valve 602*i* is a pilot controlled check valve controlled by solenoid valve 602*d*. When solenoid valve 602*d* is open, pressurized fluid passing to solenoid valve 602*d* will maintain check valve 602*i* in a bi-directional flow configuration, whereby fluid flow through check valve 602*i* can flow to and from hydraulic piston 602*e*. When solenoid valve 602*d* is closed, check valve 602*i* reverts to a one-way flow configuration, whereby hydraulic fluid can flow from hydraulic piston 602*e* back to line 602*c* and the hydraulic fluid side of piston 602*b* but where hydraulic fluid flow from line 602*c* to hydraulic piston 602*e* is blocked. Of course, those skilled in the art will appreciate that depending on the particular control configuration desired, solenoid valve 602*d* may be configured to be open in an unenergized state and closed when energized, or vice-versa. Thus, in certain preferred embodiments, solenoid valve 602*d* may default to an open position when no power is applied, but close when energized, i.e., when surface control is applied. In such a configuration, hydraulic pressure on piston 602*e* will only be maintained to keep teeth 602*g* and 602*f* from engaging one another, i.e., an unlocked configuration, when solenoid valve 602*d* is energized. Loss of power (and hence an open solenoid valve 602*d*) coupled with loss of pressure (such as when pumps, not shown, are off) will result in hydraulic pressure bleed down (via the two way flow configuration of check valve 602*i*) and hence, allow teeth 602*g* and 602*f* to engage one another, i.e., a locked configuration. Loss of power (and hence an open solenoid valve 602*d*) but with pumps still operating to maintain hydraulic pressure will continue to maintain teeth 602*g* and 602*f* in an unlocked configuration. While check valve 602*i* is described in certain embodiments as being controlled by a solenoid valve, in other embodiments, check valve 602*i* may be controlled by other equipment. A lock position sensor 604*h* may be provided and coupled to a communication line 620 to permit surface monitoring of the position of the shaft locking member 602*f* relative to the housing locking member 602*g*.

The anti-rotation mechanism 604, as previously described herein, engages the wall of wellbore W under actuation from a pressurized fluid. In some embodiments, the anti-rotation mechanism 604 includes at least one, and preferably a plurality of hydraulic pistons 604*a*, 604*b*, and 604*c* that are driven by the pressurized hydraulic fluid from pump 614. Those of ordinary skill in the art will appreciate that the foregoing hydraulic pistons 604*a*, 604*b* and 604*c* may be any pistons utilized in the anti-rotation mechanism 604 for actuation, such as for example, piston 406 of FIG. 4 or piston 502 of FIG. 5. Moreover, while the mechanism for actuation utilizing a pressurized fluid is described in certain embodiments as a piston, it may be any mechanism that can be displaced under pressure from hydraulic fluid. In any event, an anti-rotation position sensor 604*d* may be coupled to a communication line 620 to permit surface monitoring of the position of the anti-rotation devices relative to the housing (e.g., the housing 202) of the rotary steerable drilling system 600.

Figure 7:
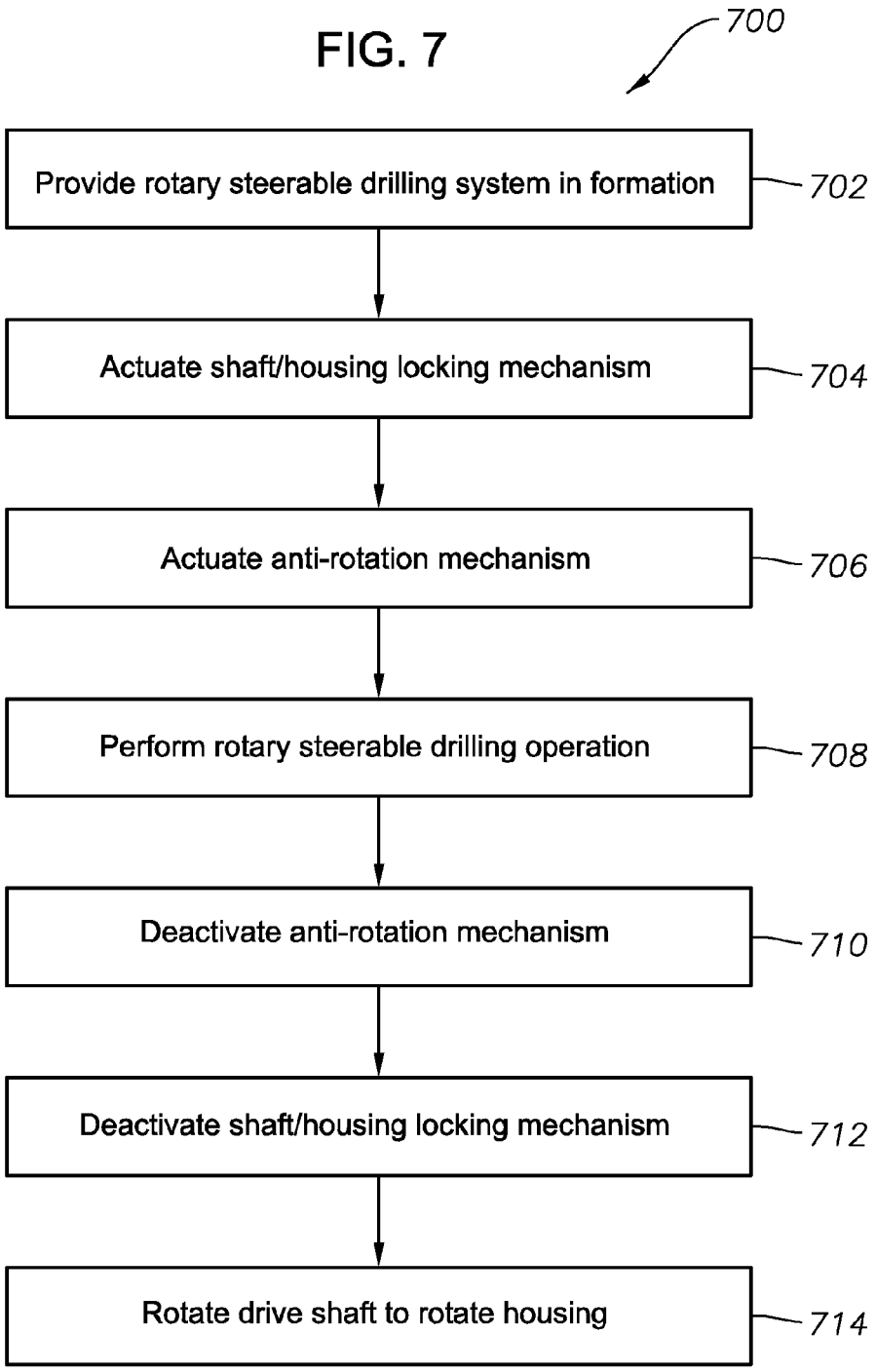
FIG. 7 is a flow chart illustrating an embodiment of a method for rotary steerable drilling.

Referring now to FIG. 7, an embodiment of a method 700 for rotary steerable drilling is illustrated. The method 700 begins at block 702 where a rotary steerable drilling system is provided in a formation. In an embodiment, the rotary steerable drilling systems 200 or 300, as illustrated in FIGS. 2*a* and 2*b*, or 3*a* and 3*b*, respectively, and/or including the anti-rotation mechanisms 400 or 500 illustrated in FIG. 4 or 5, may be provided on the drill string S illustrated in FIG. 1. As is known in the art, the drill bit B may be used to drill the wellbore W into the formation F such that the rotary steerable drilling system is deployed in the wellbore W.

In an embodiment, the rotary steerable drilling system of the present disclosure may be configured to be biased into a non-rotary state that permits the rotary steerable drilling system to move easily through the wellbore W. Thereafter, the rotary steerable drilling system may then be actuated when rotary steerable drilling operations are desired, as described in further detail below. Thus, at block 702 of the method 700, the rotary steerable drilling system is biased into its non-rotary state as the drill bit B drills into the formation F.

In an embodiment, the non-rotary steerable drilling state of the rotary steerable drilling system 200 is effectuated by biasing member 218 that provides a force that urges the shaft locking member 208 of anti-rotation mechanism 212 in the direction 220. Specifically, when the pressure of any hydraulic fluid in the shaft locking member actuation channel 210 is below a particular threshold, the biasing force provided by the biasing member 218 urges the shaft locking member 208 into engagement with the housing locking member 204. In those embodiments where the shaft locking member 208 and the housing locking member 204 are provided with teeth, the teeth 208*a* on the shaft locking member 208 become positioned in the teeth channels defined by the teeth 204*a* on the housing locking member 204, and the teeth 204*a* on the housing locking member 204 become positioned in the teeth channels defined by the teeth 208*a* on the shaft locking member 208. Similarly, in an embodiment, the non-rotary steerable drilling state of the rotary steerable drilling system 300 is effectuated by spring member 304*a* that provides a force that urges the shaft locking member 208 in the direction 308. Specifically, when the pressure of any hydraulic fluid in the shaft locking member actuation channel 302 is below a particular threshold, the biasing force provided by the spring member 304*a* urges the shaft locking member 208 into engagement with the housing locking member 204. In those embodiments where the shaft locking member 208 and the housing locking member 204 are provided with teeth, the teeth 208*a* on the shaft locking member 208 become positioned in the teeth channels defined by the teeth 204*a* on the housing locking member 204, and the teeth 204*a* on the housing locking member 204 become positioned in the teeth channels defined by the teeth 208*a* on the shaft locking member 208. The teeth 204*a* and 208*a* of the housing locking member 204 and the shaft locking member 208 (e.g., the shaft/housing locking mechanism), respectively, are illustrated in a locked orientation L on the rotary steerable drilling system 300 illustrated in FIG. 3*a*, and are illustrated in an unlocked orientation U on the rotary steerable drilling system 200 illustrated in FIG. 2*a*.

Furthermore, when the rotary steerable drilling system 200 is in its non-rotary state, the force provided by the biasing member 218 also urges the anti-rotation actuator 214 in the direction 220, thereby constraining ramp member 214*b* and the formation engagement device actuator 214*c* from extending the formation engagement device 216 from the housing 202. In other words, the formation engagement device 216 includes a first state in which it is retracted and a second state in which it is extended. Similarly, when the rotary steerable drilling system 300 is in its non-rotary state, anti-rotation members 216 may have a first state in which anti-rotation members 216 are retracted and a second state in which anti-rotation members 216 extend from the anti-rotation mechanism base 304*c*. The particular state of anti-rotation members 216 is controlled by the hydraulic fluid supplied by the shaft locking member actuation channel 302 which results in axial movement of anti-rotation/biasing member 304.

Therefore, in one embodiment at block 702 of the method 700, the rotary steerable drilling system 200 or 300 may be in a non-rotary state with the shaft/housing locking mechanism in a locked state.

The method 700 then proceeds to block 704 where the shaft/housing locking mechanism is actuated to unlock the engaged components. Specifically, in an embodiment, a force is applied to the shaft locking member 208 that is sufficient to overcome the biasing force provided by the biasing member 218 or spring member 304*a* in order to move the shaft locking member 208 in a direction that is opposite the directions 220 or 308, respectively.

For example, with reference to the rotary steerable drilling system 200 illustrated in FIGS. 2*a* and 2*b*, pressurized hydraulic fluid is allowed to flow through the shaft locking member actuation channel 210 to the shaft locking member 208, where the pressurized fluid applies an actuation force to the shaft locking member 208, the actuation force applied in a direction opposite the direction 220. In certain embodiments, the pressurized fluid impinges on and provides an actuation force to pressure surface 208*b*. Pressure surface 208*b* may be a flange, shoulder or similar structure with an enlarged surface area. That actuation force moves the shaft locking member 208 in a direction opposite the direction 220, thereby compressing the biasing member 218 and causing the shaft locking member 208 to disengage the housing locking member 204 (e.g., such that the teeth 208*a* on the shaft locking member 208 are no longer positioned in the teeth channels defined by the teeth 204*a* on the housing locking member 204, and the teeth 204*a* on the housing locking member 204 are no longer positioned in the teeth channels defined by the teeth 208*a* on the shaft locking member 208.) Thus, at block 704, the shaft/housing locking mechanism on the rotary steerable drilling system 200 is actuated causing it to transition from a locked state to an unlocked state by disengaging the shaft locking member 208 and the housing locking member 204. As discussed in further detail below, the disengagement of the shaft locking member 208 and the housing locking member 204 to put the shaft/housing locking mechanism into the unlocked state permits the drive shaft 206 to rotate independently of the housing 202.

In another example, with reference to the rotary steerable drilling system 300 illustrated in FIGS. 3*a* and 3*b*, pressurized hydraulic fluid is allowed to flow through the shaft locking member actuation channel 302 to the shaft locking member 208, where the pressurized fluid applies an actuation force to the shaft locking member 208, the actuation force applied in a direction opposite the direction 308. In certain embodiments, the pressurized fluid impinges on and provides an actuation force to pressure surface 208*b*. Pressure surface 208*b* may be a flange, shoulder or similar structure with an enlarged surface area. That actuation force moves the shaft locking member 208 in a direction opposite the direction 308, thereby compressing the spring member 304*a* and causing the shaft locking member 208 to disengage the housing locking member 204 (e.g., such that the teeth 208*a* on the shaft locking member 208 are no longer positioned in the teeth channels defined by the teeth 204*a* on the housing locking member 204, and the teeth 204*a* on the housing locking member 204 are no longer positioned in the teeth channels defined by the teeth 208*a* on the shaft locking member 208.) Thus, at block 704, the shaft/housing locking mechanism on the rotary steerable drilling system 300 is actuated causing it to transition from a locked state to an unlocked state by disengaging the shaft locking member 208 and the housing locking member 204. As discussed in further detail below, the disengagement of the shaft locking member 208 and the housing locking member 204 to put the shaft/housing locking mechanism into the unlocked state permits the drive shaft 206 to rotate independently of the housing 202.

In another example, with reference to the rotary steerable drilling system 600 illustrated in FIG. 6, the solenoid valve 602*d* may be maintained in a first position such that a hydraulic fluid that is pressured by the drilling mud (through the hydraulic piston 602*b*) maintains check valve 602*i* in a two-way flow configuration and hydraulic fluid flows through check valve 602*i* to the hydraulic piston 602*e* to actuate the shaft locking member 602*f* causing it to disengage from housing locking member 602*g* into an unlocked state (e.g., such that the teeth on the shaft locking member 602*f* are no longer positioned in the teeth channels defined by the teeth on the housing locking member 602*g*, and the teeth on the housing locking member 602*g* are no longer positioned in the teeth channels defined by the teeth on the shaft locking member 602*f*.) In certain embodiments, the solenoid valve may have a first open position when unenergized or upon loss of power and a second closed position when energized. Those skilled in the art will appreciate that upon a loss of power, the solenoid valve will close, thereby terminating flow of pressurized fluid used to maintain the shaft/housing locking mechanism in the first configuration. Thus, at block 704, the shaft/housing locking mechanism of the rotary steerable drilling system 600 is driven from a locked state to an unlocked state by disengaging the shaft locking member 602*f* and the housing locking member 602*g* from one another. As discussed in further detail below, by disengaging the shaft locking member 602*f* and the housing locking member 602*g*, the drive shaft is permitted to rotate independently of the housing. At block 704 of the method 700, the lock position sensor 604*h* may be utilized to send a communication through the communication line 620 to a surface monitoring station to indicates the locked and/or unlocked state of the shaft/housing locking mechanism.

The method 700 then proceeds to block 706 where the anti-rotation mechanism is actuated. In some of the embodiments illustrated and described below, the hydraulic force applied to the shaft locking member 208 at block 704 that is sufficient to overcome the biasing force provided by the biasing member 218 or spring member 304*a* in order to move the shaft locking member 208 in the direction that is opposite the directions 220 or 308, respectively, also provides actuation of the anti-rotation mechanism. However, one of skill in the art will recognize that each of the shaft/housing locking mechanism and the anti-rotation mechanism may be actuated separately while remaining within the scope of the present disclosure.

For example, with reference to the rotary steerable drilling system 200 illustrated in FIGS. 2*a* and 2*b*, the hydraulic fluid force that is introduced to actuate the shaft locking member 208 (via channel 210) in a direction opposite the direction 220, is transmitted from the shaft locking member 208, through the bearing 214*a*, to the anti-rotation actuator 214. That force moves the anti-rotation actuator 214 in a direction opposite the direction 220, compressing the biasing member 218 and causing the ramp member 214*b* to move relative to the formation engagement device actuator 214*c*. The movement of the ramp member 214*b* relative to the formation engagement device actuator 214*c* causes the formation engagement device actuator 214*c* to move up the ramp member 214*b* and in a radial direction relative to and away from the drive shaft 206, to bear against the formation engagement device 216. As the formation engagement device actuator 214*c* continues to move radially outward against the formation engagement device 216, the formation engagement device 216 extends radially relative to the housing 202 until the formation engagement device 216 engages the formation F defines the wellbore W. Thus, at block 706, the anti-rotation mechanism on the rotary steerable drilling system 200 is driven from a rotation state into an anti-rotation state by moving the anti-rotation actuator 214 so as to cause the formation engagement device 216 to engage the wall of the wellbore W. As discussed in further detail below, the engagement of the anti-rotation mechanism and the wall of the wellbore W resists relative rotation between the housing 202 and the formation F.

In another example, with reference to the rotary steerable drilling system 300 illustrated in FIGS. 3*a* and 3*b*, the pressurized hydraulic fluid, which flows through the shaft locking member actuation channel 302 to introduce a force on the shaft locking member 208 in a direction opposite the direction 308, also flows into the anti-rotation member actuation channel 306*a* to cause the one or more anti-rotation members 216 to extend from the anti-rotation mechanism base 304*c*. In an embodiment, the extension of the one or more anti-rotation members 216 may cause a formation engagement device (e.g., similar to the formation engagement device 216 illustrated in FIGS. 2*a* and 2*b*) to extend radially relative to the housing 202 and into engagement with the formation F that defines the wellbore W. In another embodiment, the one or more anti-rotation members 216 may themselves extend radially relative to the housing 202 and engage the formation F. Thus, at block 706, anti-rotation mechanism of the rotary steerable drilling system 300 is driven from a rotation state to an anti-rotation state by moving the anti-rotation members 216 so as to cause the anti-rotation members 216 or another formation engagement device to engage the wall of the wellbore W.

As discussed in further detail below, the engagement of the anti-rotation mechanism and the wall of the wellbore W resists relative rotation between the housing 202 and the formation F.

In another example, with reference to the anti-rotation mechanism 400 illustrated in FIG. 4, pressurized hydraulic fluid is allowed to flow, for example, from shaft locking member actuation channel 210 or the shaft locking member actuation channel 302, through the actuation channel 404*a* and into bores 404*b* in order to actuate the actuation pistons 406. Actuation of the actuation pistons 406 will cause the compression of biasing members in the biasing member mechanism 402 such that the formation engagement member 410 extends radially into engagement with the wall of wellbore W. For example, each of the first section 412 and the second section 414 may pivot about their pivotal couplings 412*a* and 414*a*, respectively, such that the third section 416 is moved radially away from the drive shaft 206, as illustrated in FIG. 4, causing wheels 418 and 420 to engage the wall of the wellbore W. Thus, at block 706, the anti-rotation mechanism 400 is actuated to cause the rotary steerable drilling system to transition from a rotation orientation into an anti-rotation orientation by engaging the formation engagement member 410 with the formation F. As discussed in further detail below, the engagement of the anti-rotation mechanism and the wall of the wellbore W resists relative rotation between the housing 202 and the formation F.

In another example, with reference to the anti-rotation mechanism 500 illustrated in FIG. 5, pressurized hydraulic fluid is allowed to flow, for example, from shaft locking member actuation channel 210 or the shaft locking member actuation channel 302, through the actuation channel 502*a* in order to actuate piston 504. Actuation of the piston 504 will cause the compression of biasing member 506 such that formation engagement member 508 extends into engagement with the formation F. For example, each of the first section 508*a* and the second section 508*b* may pivot about their pivotal couplings 506*a*, 508*c*, and 508*d*, respectively, such that the engagement wheel 510 is moved radially away from the drive shaft 206, as illustrated in FIG. 5, causing wheel 510 to engage the wall of the wellbore W. Thus, at block 706, the anti-rotation mechanism 500 is actuated to cause the rotary steerable drilling system to transition from a rotation orientation into an anti-rotation orientation by engaging the formation engagement member 508 with the formation F. As discussed in further detail below, the engagement of the anti-rotation mechanism and the wall of the wellbore W resists relative rotation between the housing 202 and the formation F.

In some embodiments, e.g., those illustrated in FIGS. 4 and 5, the anti-rotation mechanism 400 or 500 provides engagement wheels 418 and 420 or 510, respectively, that engage the formation F to prevent relative rotation between the housing 202 and the formation F (e.g., about the longitudinal axis of the drill string S) while still allowing the anti-rotation mechanism and the housing to be moved axially (e.g., along the longitudinal axis of the drill string S). Furthermore, the formation engagement members 410 and 508 may be coupled to resilient members in order to allow for resilient movement of the formation engagement members 410 and 508 when the engagement wheels 418 and 420 or 510 move axially along an uneven wall of the wellbore W. In certain embodiments, such a resilient member may be spring loading the pivotal couplings 412*a*, 414*a*, 416*a*, and 416, or 506*a*, 508*c*, and 508*d*. In certain embodiments, the pressure in the hydraulic cylinders (e.g., 404*b*, 502*a*) may be held above the spring force of those spring members in order to ensure that the pistons (e.g., 406, 504) in those cylinders do not move and cause seal problems.

In another example, with reference to the rotary steerable drilling system 600 illustrated in FIG. 6, the solenoid valve 618 has an open and closed configuration, which may be coordinated with an energized and unenergized state as desired for particular control parameters. In a closed position, pressurized hydraulic fluid from the pump 614 will flow to the hydraulic pistons 604*a*, 604*b*, and 604*c* to drive the anti-rotation mechanism from a rotation orientation to an anti-rotation orientation. In an open position, pressurized hydraulic fluid will flow back through solenoid valve 618 to a reservoir, such as a maximum pressure reservoir 616. In certain embodiments, the solenoid valve 618 is in the open configuration when unernergized (or in the event of power loss) while solenoid valve 618 is in the closed configuration when energized. Those skilled in the art will appreciate that upon a loss of power, the solenoid valve will open, thereby terminating flow of pressurized fluid used to maintain the anti-rotation mechanism in the first configuration. In other words, loss of power or surface control will result in retraction of the anti-rotation mechanism 604 from engagement with the wellbore W wall. Thus, at block 704, the anti-rotation mechanism on the rotary steerable drilling system 600 is actuated to cause the rotary steerable drilling system to transition from a rotation orientation into an anti-rotation orientation by engaging the anti-rotation mechanism 604 with the formation F. As discussed in further detail below, the engagement of the anti-rotation mechanism 604 and the wall of the wellbore W resists relative rotation between the housing 202 and the formation F. At block 706 of the method 700, the anti-rotation position sensor 604*d* may send a communication along the communication line 620 to a surface monitoring station to indicate that the anti-rotation mechanism is in the anti-rotation orientation. Solenoid valve 618 also has a closed position in which pressurized hydraulic fluid used to maintain the anti-rotation mechanism in the first configuration is circulated through valve 618, thereby bleeding off pressure supplied to the hydraulic pistons 604*a*, 604*b* and 604*c* and causing anti-rotation mechanism 604 to withdraw from engagement with the formation F. Those skilled in the art will appreciate that by maintaining the solenoid valve in an open position when unenergized, a loss of power (which might accompany, for example, a loss of surface control) will result in automatic disengagement of the anti-rotation mechanism 604 with the formation F. In other words, rotary steerable drilling system 600 is configured to revert to a state that aids in withdrawal of the drill string, when surface control is lost.

The method 700 then proceeds to block 708 where a rotary steerable drilling operation is performed. Following blocks 704 and 706 of the method 700, the rotary steerable drilling system is in a rotary steerable drilling orientation, with the shaft/housing locking mechanism in an unlocked position such that the drive shaft 206 may rotate independent from the housing 202, and the anti-rotation mechanism in an anti-rotation configuration, engaging the formation F to inhibit rotation of the housing 202 relative to the formation F. Thus, at block 708, the housing 202 may remain rotationally stationary relative to the formation F while the drive shaft 206 rotates and rotary steerable drilling system components are actuated to steer the drill bit B in a desired direction in the wellbore W relative to the known (stationary) position of the housing 202. While a few examples of rotary steerable drilling operations have been described above, one of skill in the art will recognize that a variety of rotary steerable drilling operations will fall within the scope of the present disclosure.

In the event that the housing 202 becomes stuck in the wellbore, it may be necessary to undertake recovery operations, which recovery would be inhibited if the housing remained engaged with the formation F and unlocked from the drive shaft 206. Thus, the method 700 proceeds to block 710 where the anti-rotation mechanism is deactivated. In the embodiments illustrated and described below, preferably a single operable force, such as the force from the hydraulic fluid, drives both the shaft/housing locking mechanism to an unlocked state and the anti-rotation mechanism to a formation engagement state. As such removal of the force will correspondingly result in disengagement of the formation and locking of the housing to the shaft. However, persons of skill in the art will recognize that each of the shaft/housing locking mechanism and the anti-rotation mechanism may be operated separately while remaining within the scope of the present disclosure.

For example, with reference to the rotary steerable drilling system 200 illustrated in FIGS. 2*a* and 2*b*, the force provided on the shaft locking member 208 and transmitted to the anti-rotation actuator 214, which is in a direction opposite the direction 220 and that results from the pressurized hydraulic fluid that flows through the shaft locking member actuation channel 210, may be removed by interrupting the supply of pressurized hydraulic fluid to the shaft locking member actuation channel 210. Removal of that force allows the biasing force from the biasing member 218 to move the anti-rotation actuator 214 in the direction 220, resulting in the ramp member 214*b* moving relative to the formation engagement device actuator 214*c*. The relative movement of the ramp member 214*b* and the formation engagement device actuator 214*c* results in movement of the formation engagement device actuator 214*c* down the ramp member 214*b*, in a radial direction relative to and towards the drive shaft 206, and out of engagement with the formation engagement device 216. The disengagement of the formation engagement device actuator 214*c* and the formation engagement device 216 results in retraction of the formation engagement device 216 from engagement with the formation F. Thus, at block 710, the anti-rotation mechanism on the rotary steerable drilling system 200 is driven from an anti-rotation state to a rotation state by moving the anti-rotation actuator 214 to cause the formation engagement device 216 to disengage from the wall of the wellbore W.

In another example, with reference to the rotary steerable drilling system 300 illustrated in FIGS. 3*a* and 3*b*, the force provided by the pressurized hydraulic fluid on the shaft locking member 208 and the one or more anti-rotation members 216 may be removed by interrupting the supply of pressurized hydraulic fluid from the shaft locking member channel 302. Without the actuation force that results from the pressurized hydraulic fluid, the one or more anti-rotation members 216 will cause the formation engagement device (e.g., similar to the formation engagement device 216 illustrated in FIGS. 2*a* and 2*b*) to retract, thereby disengaging from the formation F. In another embodiment, the one or more anti-rotation members 216 may themselves retract, preferably in a radial direction relative to the housing 202, to disengage the formation F. Thus, at block 710, the anti-rotation mechanism of the rotary steerable drilling system 300 is disengaged from the formation F by actuating the anti-rotation members 216

In another example, with reference to the anti-rotation mechanism 400 illustrated in FIG. 4, pressurized hydraulic fluid flow to actuation channel 404*a* from the shaft locking member actuation channel 210 or the shaft locking member actuation channel 302 may be interrupted and pressure released in order to deactivate the plurality of actuation pistons 406. Deactivation of the plurality of actuation pistons 406 will cause the formation engagement member 410 to retract from engagement with the formation F. Each of the first section 412 and the second section 414 may pivot about their pivotal couplings 412*a* and 414*a*, respectively, such that the third section 416 is moved radially towards the drive shaft 206 and the engagement wheels 418 and 420 disengage the wall of the wellbore W. Thus, at block 710, the anti-rotation mechanism 400 is driven from a first position or state in which it engages the wall of the wellbore W to inhibit rotation of housing 202 to a second position or state in which housing 202 is capable of rotation relative to the wall of wellbore W.

In another example, with reference to the anti-rotation mechanism 500 illustrated in FIG. 5, pressurized hydraulic fluid flow to channel 502 from the shaft locking member actuation channel 210 or the shaft locking member actuation channel 302 may be interrupted and pressure released in order to actuate piston 504. Specifically, release of pressure on piston 504 will in turn release an actuation force applied to biasing member 506, thereby releasing the biasing force on engagement member 508 which causes engagement member 508 to engage the formation F. By releasing biasing member 506 from biasing engagement member 508, each of the first section 508*a* and the second section 508*b* pivot about their pivotal couplings 506*a*, 508*c*, and 508*d*, respectively, such that the engagement wheel 510 is moved in a radial direction towards the drive shaft 206 and out of engagement with the wall of the wellbore W. Thus, at block 710, the anti-rotation mechanism 500 is driven from a first position in which it engages the wall of the wellbore W to inhibit rotation of housing 202 to a second position in which housing 202 is capable of rotation relative to the wall of Wellbore W.

In another example, with reference to the rotary steerable drilling system 600 illustrated in FIG. 6, the solenoid valve 618 may be open to prevent hydraulic fluid that is pressured by the pump 614 from flowing to the hydraulic pistons 604*a*, 604*b*, and 604*c*, thereby permitting hydraulic fluid pressuring the hydraulic pistons to be bled off in order to deactivate anti-rotation mechanism 604. Thus, at block 710, the anti-rotation mechanism 604 on the rotary steerable drilling system 600 is driven from a first position or state in which it engages the wall of the wellbore W to inhibit rotation of housing 202 to a second position or state in which housing 202 is capable of rotation relative to the wall of wellbore W. At block 710 of the method 700, the anti-rotation position sensor 604*d* may send a communication along the communication line 620 to a surface monitoring station indicating the orientation of anti-rotation mechanism 604.

The method 700 then proceeds to block 712 where the shaft/housing locking mechanism is deactivated. As discussed above, in certain preferred embodiments, the force used to actuate the shaft/housing locking mechanism can also be used to actuation the anti-rotation mechanism. However, one of skill in the art will recognize that each of the shaft/housing locking mechanism and the anti-rotation mechanism may be actuated separately while remaining within the scope of the present disclosure.

For example, with reference to the rotary steerable drilling system 200 illustrated in FIGS. 2*a* and 2*b*, by bleeding off the pressurized hydraulic fluid in channel 210, the force on the shaft locking member 208 that was urging it in the direction opposite the direction 220 is removed, and the shaft locking member 208 is again biased in the direction 220, causing shaft locking member 208 to engage the housing locking member 204 (e.g., such that the teeth 208*a* on the shaft locking member 208 are interleaved with the teeth 204*a* on the housing locking member 204. Thus, at block 712, the shaft/housing locking mechanism on the rotary steerable drilling system 200 is driven from an unlocked position to a locked position by engaging the shaft locking member 208 and the housing locking member 204. As discussed in further detail below, the engagement of the shaft locking member 208 and the housing locking member 204 permits rotation of the housing 202 with corresponding rotation of the drive shaft 206.

In another example, with reference to the rotary steerable drilling system 300 illustrated in FIGS. 3*a* and 3*b*, by bleeding off the pressurized hydraulic fluid channel 302, the force on the shaft locking member 208 that was urging it in the direction opposite the direction 308 is removed, and the shaft locking member 208 is once again biased in the direction 308, causing shaft locking member 208 to engage the housing locking member 204 (e.g., such that the teeth 208*a* on the shaft locking member 208 are interleaved with the teeth 204*a* on the housing locking member 204. Thus, at block 712, the shaft/housing locking mechanism on the rotary steerable drilling system 300 is driven from an unlocked position to a locked position by engaging the shaft locking member 208 and the housing locking member 204. As discussed in further detail below, the engagement of the shaft locking member 208 and the housing locking member 204 permits rotation of the housing 202 with corresponding rotation of the drive shaft 206.

In another example, with reference to the rotary steerable drilling system 600 illustrated in FIG. 6, the solenoid valve 602*d* may be closed to prevent hydraulic fluid that is pressured by the drilling mud (through the hydraulic piston 602*b*) from flowing to hydraulic piston 602*e*, thereby permitting hydraulic fluid pressuring the hydraulic piston 602*e* to be bled off through check valve 602*i* and causing the shaft locking member 602*f* and the housing locking member 602*g* to engage one another (e.g., such that the teeth on the shaft locking member 602*f* are interleaved with the teeth on the housing locking member 602*g*. Thus, at block 712, the shaft/housing locking mechanism on the rotary steerable drilling system 600 is driven from an unlocked position to a locked position by engaging the shaft locking member 602*f* and the housing locking member 602*g*. As discussed in further detail below, the engagement of the shaft locking member 602*f* and the housing locking member 602*g* permits rotation of the housing 202 with corresponding rotation of the drive shaft 206. At block 712 of the method 700, the lock position sensor 604*h* may send a communication along the communication line 620 to a surface monitoring station that indicates that the shaft/housing locking mechanism is in the locked position.

In an embodiment, at blocks 710 and 712 of the method 700, a timing mechanism 222 (FIG. 2B) may be utilized for the deactivation of the anti-rotation mechanism and the shaft/housing mechanism that ensures that the anti-rotation mechanism transitions from the anti-rotation position or configuration to the rotation position or configuration before the shaft/housing locking mechanism transitions from the unlocked position or orientation to the locked position or configuration. For example, restrictions may be included in the hydraulic fluid supply paths to the shaft/housing locking mechanism and the anti-rotation mechanism such that the hydraulic fluid to the anti-rotation mechanism bleeds off more quickly than the hydraulic fluid to the shaft/housing locking mechanism, thus ensuring that the anti-rotation mechanism will disengage the formation before the shaft/housing locking mechanism transitions to its locked position. Similarly, this timing mechanism 222 may ensure that the shaft/housing locking mechanism transitions to an unlocked configuration before the anti-rotation mechanism engages the formation F in response to the application of hydraulic fluid to the system. Thus, in some embodiments, the anti-rotation mechanism may only engage the formation once the housing 202 is unlocked from the drive shaft 206, and the housing 202 may only lock to the drive shaft 206 when the anti-rotation mechanism is disengaged from the formation F.

The method 700 then proceeds to block 714 where a drive shaft is rotated to rotate the housing. As discussed above, the engagement of the shaft locking member 208 and the housing locking member 204 to put the shaft/housing locking mechanism into the locked configuration permits rotation of the drive shaft 206 to cause rotation of the housing 202. With the anti-rotation mechanism disengaged from the wall of the wellbore, the drive shaft 206 may be driven and, due to the shaft/housing locking mechanism being in the locked orientation, the housing 202 will rotate along with the drive shaft 206.

Thus, in certain preferred embodiments, a rotary steerable drilling system 600 may have a first configuration where an anti-rotation mechanism 604 engages the wall of the wellbore W and the shaft locking member 602*f* is disengaged from the housing locking member 602*g*. The shaft locking member 602*f* must be disengaged prior to the anti-rotation mechanism engaging 604 the wall of the wellbore W. Similarly, the anti-rotation mechanism 604 must disengage the wall of wellbore W prior to locking the shaft locking member 602*f*. In this first configuration, solenoid valve 602*d* is energized so as to be open in order to maintain check valve 602*i* as a two-way flow orifice. Likewise, solenoid valve 618 is energized so as to be closed in order to maintain activation pressure on anti-rotation mechanism 604. Under controlled conditions, i.e., when there is control of wellbore pressure and downhole controls are operable, rotary steerable drilling system 600 may be driven to a second configuration by deenergizing solenoid valve 602*d* and solenoid valve 618. In such case, solenoid valve 618 will open and the hydraulic pressure maintaining anti-rotation mechanism 604 in the first configuration will bleed off, thereby driving anti-rotation mechanism 604 to the second configuration. In order to drive shaft locking member 602*f* and housing locking member 602*g* into engagement, wellbore pressure must be decreased (generally through manipulation of mud pumps), thereby releasing pressure on piston 602*b* which in turn, will allow hydraulic fluid in piston 602*e* to flow through check valve 602*i* back to the hydraulic side of piston 602*b*. Those of ordinarily skill in the art will appreciate that in the event of loss of controls, such as loss of electrical power to a rotary steerable drilling system 600, anti-rotation mechanism 604 will automatically be driven to the second configuration and a controlled engagement of drive shaft locking member 602*f* and housing locking member 602*g* can be achieved by manipulating the wellbore fluid pressure. Those of ordinary skill in the art also will appreciate that preferably, the shaft locking member 602*f* must unlock or disengage prior to engagement of the anti-rotation mechanism 604 with the wellbore W. Similarly, the anti-rotation mechanism 604 must disengage the wellbore W prior to locking of the shaft locking member 602*f*.

One of skill in the art will recognize several benefits provided by the system and method of the present disclosure. For example, the shaft/housing locking mechanism may be positioned in the locked configuration and the anti-rotation mechanism may be positioned in the rotation configuration in order to drill into the formation F while the housing 202 is disengaged from the formation F and rotates with the drive shaft 206. At a point during the drilling, the shaft/housing locking mechanism and the anti-rotation mechanism may be actuated in order to unlock the housing 202 from the drive shaft 206 and engage the anti-rotation mechanism with the formation F such that the housing 202 is rotationally stationary relative to the formation F and the drive shaft 206 may rotate relative to the housing 202 to perform rotary steerable drilling operations. The shaft/housing locking mechanism and the anti-rotation mechanism may then be deactivated in order to lock the housing 202 to the drive shaft 206 and disengage the anti-rotation mechanism from the formation F such that the housing 202 may be rotated with the drive shaft 206 for continued drilling. This process may be repeated as many times as rotary steerable drilling operations are necessary. Furthermore, as is known in the art, during rotary steerable drilling operations the drill string S can become stuck in the formation F. In response to such a situation, the system and method of the present disclosure allow the anti-rotation mechanism may be driven to disengage the formation F, followed by configuration of the shaft/housing locking mechanism to lock the housing 202 to the drive shaft 206 such that rotation of the drive shaft 206 causes corresponding rotation of the housing 202. Thus, the drive shaft 206 may be rotated to cause rotation of the housing 202 relative to the formation F that can help "unstick" the drill string S from the formation F.

Furthermore, the system and method of the present disclosure provide a fail safe position in which the housing 202 is locked to the drive shaft 206 and the anti-rotation mechanism is disengaged from the formation F when loss of pressure or loss of electric power to drilling the system occurs. As would be understood from the description above by one of skill in the art, a loss of power to the system will result in hydraulic fluid bleed off, followed by the shaft/housing locking mechanism and the anti-rotation mechanism being biased into their unactuated configurations (e.g., with the shaft locking member 208 and housing locking member 204 engaged, and with the anti-rotation mechanism retracted from the wall of the wellbore W). Thus, upon system failure, the rotary steerable system of the present disclosure is driven to a configuration that makes it easier to remove the drill string S from the formation F.

Thus, a system and method have been described that provide for the locking and unlocking of a reference housing to a drive shaft in a rotary steerable drilling system, and the engagement and disengagement of an anti-rotation mechanism in a rotary steerable drilling system. Such systems provide, for example, for rotary steerable drilling with an enhanced ability to dislodge the drill string from the formation.

Several sources of power for the systems and methods discussed above may be available. For example, bit differential pressure, shaft rotation, hydraulics pumped electrically, electrical motors, and/or a variety of other power sources known in the art may be used to power the rotary steerable drilling systems discussed above. However, the hydraulic system illustrated and described above provides several benefits including high power density and the ability to provide a fail safe orientation by allowing hydraulic fluid bleed-off to a reservoir.

It is understood that variations may be made in the foregoing without departing from the scope of the disclosure.

Any spatial references such as, for example, "upper," "lower," "above," "below," "between," "bottom," "vertical," "horizontal," "angular," "upwards," "downwards," "side-to-side," "left-to-right," "left," "right," "right-to-left," "top-to-bottom," "bottom-to-top," "top," "bottom," "bottom-up," "top-down," etc., are for the purpose of illustration only and do not limit the specific orientation or location of the structure described above.

While the foregoing has been described in relation to a drill string and is particularly desirable for addressing dog-leg severity concerns, those skilled in the art with the benefit of this disclosure will appreciate that the drilling systems of this disclosure can be used in other drilling applications without limiting the foregoing disclosure.

What is claimed is:

1. A rotary steerable drilling system, comprising:

a housing;

a drive shaft located in the housing;

a shaft/housing locking mechanism having a first position in which rotation of the drive shaft is independent of the housing and a second position in which rotation of the drive shaft is coupled to rotation of the housing; and an anti-rotation mechanism separate from and independent of said shaft/housing locking mechanism coupled to the housing;

wherein the anti-rotation mechanism has a first configuration in which the anti-rotation mechanism is extended radially relative to the drive shaft; and wherein the anti-rotation mechanism has a second configuration in which the anti-rotation mechanism is retracted towards the drive shaft relative to the first configuration.

2. The drilling system of claim 1, wherein the anti-rotation mechanism includes a biasing member that biases the anti-rotation mechanism into the second configuration.

3. The drilling system of claim 1, wherein the anti-rotation mechanism comprises:

a resilient member biased radially outward from the drive shaft, the resilient member disposed to permit radial movement of the anti-rotation mechanism when the anti-rotation mechanism is in the first configuration.

4. The drilling system of claim 1, wherein the shaft/housing locking mechanism includes:

a housing locking member carried by the housing; and a shaft locking member carried by the drive shaft;

wherein the shaft locking member is moveable relative to the housing locking member from an unengaged position in which the shaft/housing locking mechanism is in the unlocked orientation and into an engaged position in which the shaft/housing locking mechanism is in the second position.

5. The drilling system of claim 4, wherein the shaft/housing locking mechanism includes a biasing member that biases the housing locking member and the shaft locking member into engagement with one another.

6. The drilling system of claim 1, further comprising:

a timing mechanism disposed to cause the anti-rotation mechanism to transition from the first configuration to the second configuration before the shaft/housing locking mechanism transitions from the first configuration to the second configuration.

7. A method for rotary steerable drilling, comprising:

providing a drill string including a housing, a drive shaft within the housing, a shaft/housing locking mechanism and an anti-rotation mechanism, wherein said anti-rotation mechanism is separate from and independent of said shaft/housing locking mechanism;

actuating the shaft/housing locking mechanism and driving it into a first configuration such that rotation of the drive shaft is independent of the housing;

actuating the anti-rotation mechanism and driving it into a first configuration in which the anti-rotation mechanism is extended into engagement with a formation;

performing a rotary steerable drilling operation in the formation;

actuating the anti-rotation mechanism and driving it into a second configuration in which the anti-rotation mechanism disengages the formation;

actuating the shaft/housing locking mechanism and driving it into a second configuration such that rotation of the drive shaft causes rotation of the housing; and rotating the drive shaft to cause rotation of the housing.

8. The method of claim 7, further comprising:

timing the actuation of the anti-rotation mechanism and the shaft-locking mechanism such that the anti-rotation mechanism transitions from the first configuration to the second configuration before the shaft/housing locking mechanism transitions from the first configuration to the second configuration.

9. The method of claim 7, further comprising:

utilizing an electric solenoid valve having a closed position when energized and an open position when de-energized;

energizing the solenoid valve to maintain the shaft/housing locking mechanism in the first configuration.

10. The method of claim 7, further comprising:

continuing rotation of the drive shaft until the housing is free from engagement by the formation;

thereafter re-actuating the shaft/locking mechanism to drive it to the first configuration in which rotation of the drive shaft is independent of the housing; and re-actuating the anti-rotation mechanism to drive it to the first configuration in which the anti-rotation mechanism is extended into engagement with the formation.

11. The method of claim 7, further comprising:

utilizing pressurized fluid to drive anti-rotation mechanism and the shaft/housing locking mechanism into the first configurations, respectively.

12. The method of claim 7, further comprising:

utilizing an electric solenoid valve having a closed position when energized and an open position when de-energized;

energizing the solenoid valve to maintain the anti-rotation mechanism in the first configuration.

* * * * *